US010287828B2

(12) United States Patent
Savage et al.

(10) Patent No.: US 10,287,828 B2
(45) Date of Patent: May 14, 2019

(54) STABILIZER DEVICES FOR DRILLING TOOL HOUSING

(71) Applicant: Halliburton Energy Services, Inc., Houston, TX (US)

(72) Inventors: John Keith Savage, Edmonton (CA); Steven Graham Bell, Red Deer (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/560,392

(22) PCT Filed: Apr. 23, 2015

(86) PCT No.: PCT/US2015/027342
§ 371 (c)(1),
(2) Date: Sep. 21, 2017

(87) PCT Pub. No.: WO2016/171702
PCT Pub. Date: Oct. 27, 2016

(65) Prior Publication Data

US 2018/0066480 A1 Mar. 8, 2018

(51) Int. Cl.
*E21B 17/10* (2006.01)
*E21B 4/02* (2006.01)
*E21B 17/04* (2006.01)

(52) U.S. Cl.
CPC ..... *E21B 17/1078* (2013.01); *E21B 4/02* (2013.01); *E21B 17/04* (2013.01)

(58) Field of Classification Search
CPC ..... E21B 17/1078
See application file for complete search history.

(56) References Cited

U.S. PATENT DOCUMENTS 4,000,549 A 1/1977 Brumley et al.
4,105,262 A 8/1978 Richey et al.
(Continued)

FOREIGN PATENT DOCUMENTS

FR 2666372 3/1992
WO 2009151608 12/2009
(Continued)

OTHER PUBLICATIONS

International Patent Application No. PCT/US2015/027342 , "International Search Report and Written Opinion", dated Nov. 26, 2015, 16 pages.

*Primary Examiner* — Giovanna C Wright
(74) *Attorney, Agent, or Firm* — Kilpatrick Townsend & Stockton LLP

(57) ABSTRACT

A stabilizer device is provided for a mud motor drilling assembly. The stabilizer device may be mounted to a motor housing having one or more grooves or ridges. The stabilizer device may include a stabilizer body, a threader portion, and a clamp. The threaded portion may be positioned between the one or more grooves or ridges and the clamp. The threaded portion may include an external surface having threads. The threads on the external surface of the threaded portion of the stabilizer device may correspond to threads on an internal surface of a clamp. The threaded coupling of the clamp to the stabilizer device may couple the stabilizer device to the motor housing at the one or more grooves or ridges.

13 Claims, 5 Drawing Sheets

(56) References Cited

U.S. PATENT DOCUMENTS

| | | | | |
|---|---|---|---|---|
| 4,258,804 | A | 3/1981 | Richey et al. | |
| 4,265,470 | A | 5/1981 | Danner et al. | |
| 4,378,135 | A | 3/1983 | Enen et al. | |
| 4,384,626 | A * | 5/1983 | Derouin | E21B 17/1078 175/325.4 |
| 4,438,822 | A | 3/1984 | Russell et al. | |
| 4,560,013 | A * | 12/1985 | Beimgraben | E21B 17/10 175/325.2 |
| 4,600,063 | A | 7/1986 | Beasley et al. | |
| 4,630,690 | A | 12/1986 | Teng et al. | |
| 5,050,692 | A * | 9/1991 | Beimgraben | E21B 7/067 175/256 |
| 5,997,010 | A | 12/1999 | Lloyd et al. | |
| 6,176,318 | B1 * | 1/2001 | Drakeley | E21B 23/00 166/237 |
| 7,445,061 | B1 | 11/2008 | Falgout, Sr. et al. | |
| 8,025,110 | B2 | 9/2011 | Falgout, Jr. et al. | |
| 8,641,113 | B1 | 2/2014 | Russell et al. | |
| 9,982,494 | B2 * | 5/2018 | Steine | E21B 17/10 |
| 2011/0240370 | A1 | 10/2011 | Shwets et al. | |
| 2012/0168178 | A1 | 7/2012 | Eriksen et al. | |
| 2014/0182943 | A1 | 7/2014 | Iblings et al. | |
| 2016/0376852 | A1 * | 12/2016 | von Gynz-Rekowski | E21B 17/1078 166/380 |

FOREIGN PATENT DOCUMENTS

| | | | | |
|---|---|---|---|---|
| WO | 2014011056 | | 1/2014 | |
| WO | WO-2014011056 | A1 * | 1/2014 | E21B 17/10 |
| WO | 2014126889 | | 8/2014 | |

* cited by examiner

STABILIZER DEVICES FOR DRILLING TOOL HOUSING

CROSS-REFERENCE TO RELATED APPLICATIONS

This is a U.S. national phase under 35 U.S.C. 371 of International Patent Application No. PCT/US2015/027342 titled "Stabilizer Devices For Drilling Tool Housing" and filed Apr. 23, 2015, the entirety of which is incorporated herein by reference.

TECHNICAL FIELD

The present disclosure relates generally to an assembly for a motor shaft transmission and, more particularly (although not necessarily exclusively), to assemblies and methods for mounting a stabilizer device on a mud motor housing.

BACKGROUND

Stabilizers of varying gauges may be mounted to the outer housing of a mud motor. A threaded connection may be used to mount a stabilizer device to a mud motor housing. The threaded connection may be oriented such that the stabilizer device may pass over the lower connection of the motor, the driveshaft shoulder, and the lower section of the outer motor housing with room to tong on the body of the stabilizer device to torque the threaded connection according to a desired specification. The threaded connection may serve to locate the stabilizer device axially on the housing and, resist drag forces moving axially uphole or downhole. The threaded connection may also serve to carry torque loads from the friction drag interaction between the stabilizer and the wellbore wall when the motor is turned from the surface of the wellbore.

But, threads on the motor housing may have several disadvantages, making them undesirable for mounting a stabilizer device to a motor housing. For example, the abundance of stress raisers (e.g., thread roots, relief geometry) may aggravate fatigue and promote crack initiation. Also, threads on the motor housing are often damaged and may require time and cost penalties to extend the service life of the threaded stabilizer and motor housing. In some instances, significant thread damage may require replacement of an expensive motor housing. Further, threading on the motor housing may require increased third-party inspection, which may result in lost time and money due to additional cleaning done prior to inspection and the downtime of the drilling operations during the inspections. Similarly, threading on the motor housing may also require formal verification-of-torque processes and inspection as part of quality management procedures.

DETAILED DESCRIPTION

Figure 1:
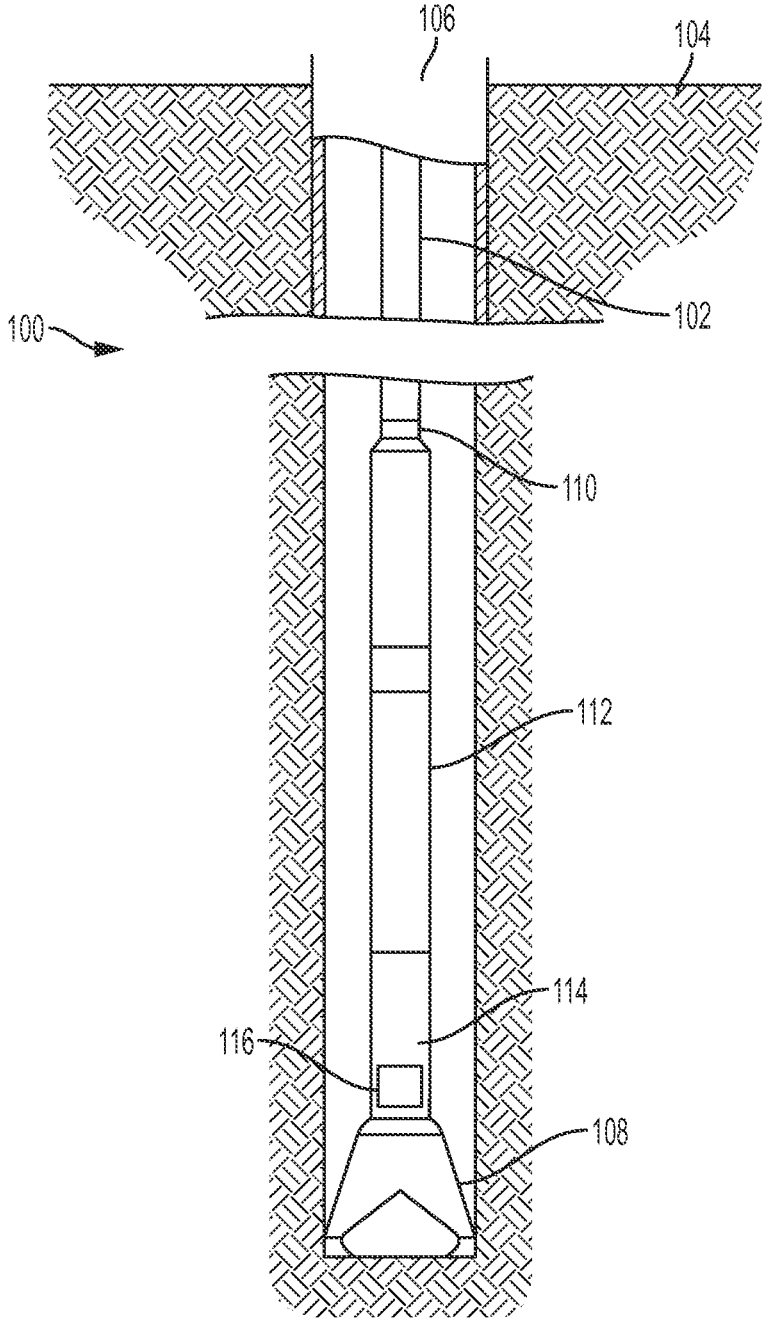
FIG. 1 is a cross-sectional schematic diagram depicting a drilling system that includes a motor shaft transmission assembly with an interference apparatus in a lower end of a downhole motor assembly according to one aspect of the present disclosure.

Certain aspects and examples of the present disclosure relate to an assembly for mounting a stabilizer device on a motor housing of a mud motor drilling assembly without the use of threads on the motor housing to locate the stabilizer. For example, a clamp may be used to couple the stabilizer device to the motor housing. In some aspects, an internal ridge on one or more split-ring shells may be inserted into a groove on the motor housing. In an alternative aspect, the split-ring shells may include an internal groove to receive a ridge on the motor housing. The stabilizer device may be placed on the motor housing near the groove or ridge to allow a threaded portion of the stabilizer device to rest on the one or more split-ring shells. The clamp may have threads corresponding to threads on the threaded portion of the stabilizer device to couple the stabilizer device to the motor housing. In other aspects, the stabilizer device may be placed on the motor housing near a groove on the motor housing to allow the threaded portion to be received in a groove. The clamp may be threadably coupled to the threaded portion to couple the stabilizer device to the motor housing.

Stabilizer devices are considered consumable components of the drilling system due to the interference of stabilizer device with the walls of a wellbore during operation. This interference makes the stabilizer device subject to wear and fatigue. The reduced fatigue life due to the presence of the threads on the stabilizer device may be tolerable, provided the minimum life criteria ensures at least one run cycle. Particularly, the assembly of the stabilizer device allows the stabilizer device to be easily demounted or uninstalled from the motor housing for replacement or repair. Threaded connections on the stabilizer device and not the housing, in addition to the ease of assembly and disassembly may save time and costs in repair, inspection, and replacement costs to the motor housing in exchange for less expensive replacement and repair of the stabilizer device.

A mud motor drilling assembly may include a motor housing and a stabilizer device. The motor housing may include one or more grooves on or one or more ridges in an external surface for mounting the stabilizer device to the motor housing. The stabilizer device may include a threaded portion that has an external surface with threads. The threads may correspond to threads on an internal surface of a clamp. The threads on the threaded portion may be mated with the threads on the clamp. The threaded portion may be positioned between the one or more grooves or ridges and the clamp. The threaded coupling of the clamp to the stabilizer device may couple the stabilizer device to the motor housing at the one or more grooves. In some aspects, the threaded portion may be positioned between split-ring shells mounted in a groove or ridge on the motor housing and the clamp. In other aspects, the threaded portion may be positioned in a groove on the motor housing.

The terms "inner," "outer," "internal," "external," and "between," as used in the present disclosure may refer to a radial orientation toward or away from the center of the mud motor drilling assembly. The terms "uphole" and "downhole," as used in the present disclosure may refer to an axial orientation toward or away from the surface.

Various aspects of the present disclosure may be implemented in various drilling systems. FIG. 1 illustrates an example of such a drilling system 100 that includes a drill string 102. The drill string 102 of a drilling rig (not shown) may include segmented pipes that may extend below the surface 104 in a borehole, such as a wellbore 106. The drill string 102 may transmit drilling fluid (or mud) and the torque necessary to operate a drill bit 108. Also, the weight of the drill string 102 may provide an axial force on the drill bit 108.

The drill string 102 may include a drill pipe 110 and a bottom hole assembly 112. The bottom hole assembly 112 may be include various components, such as a downhole motor assembly 114 and the drill bit 108.

Though placement of the assemblies disclosed herein may vary without departing from the scope of the present subject matter, the assemblies of the present disclosure may be included in the lower end of the downhole motor assembly 114 and near the drill bit 108. For example, the mud motor drilling assembly 116 of FIG. 1 represents a placement according to one example. Placement of the assemblies as close to the drill bit 108 as possible may enhance the mechanical stability of the drilling system 100. For example, the assemblies of the present disclosure may prevent unintentional sidetracking of the drill bit 108 and vibrations of the drill pipe 110 and drilling components attached thereto.

Figure 2:
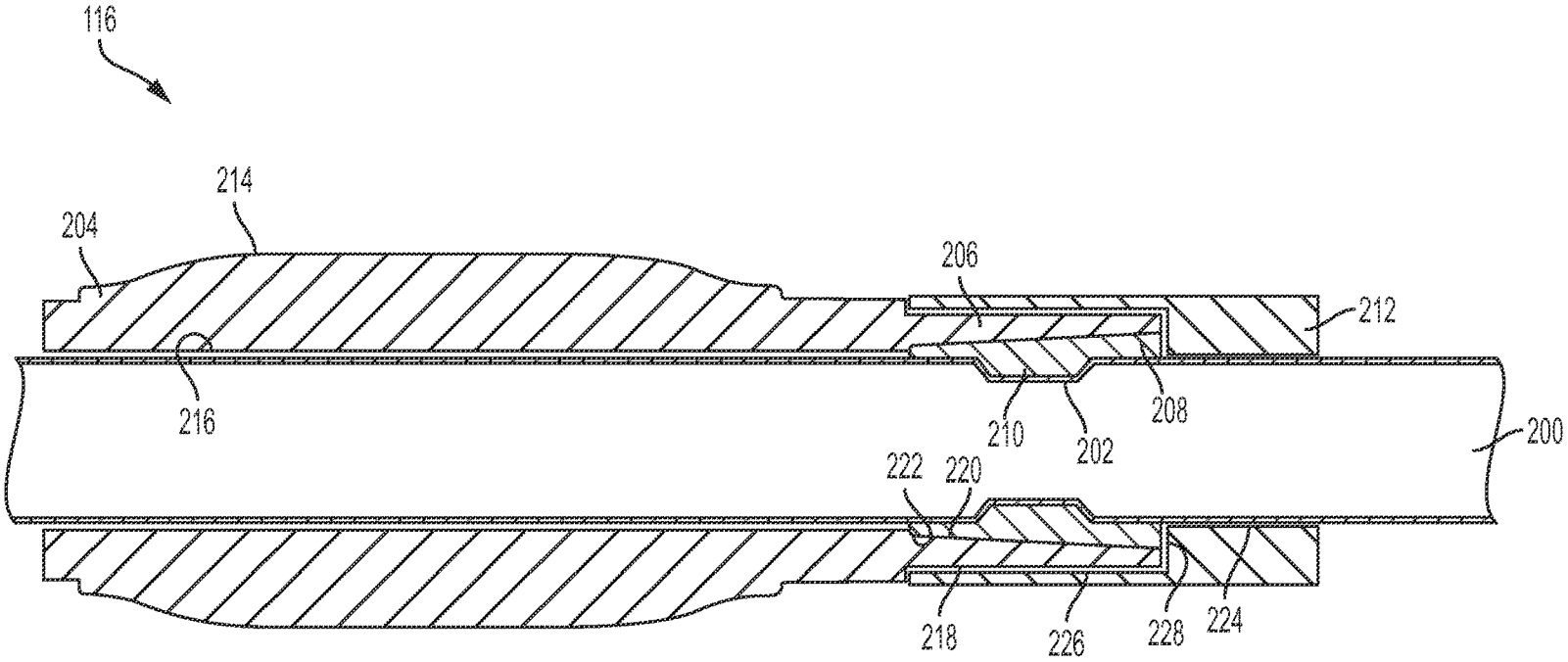
FIG. 2 is a cross-sectional view of a mud motor drilling assembly with a stabilizer device according to one aspect of the present disclosure.

FIG. 2 shows a cross-sectional view of a mud motor drilling assembly 116 that may be positioned in the downhole motor assembly 114 of the drilling system 100 of FIG. 1. The mud motor drilling assembly 116 may include a motor housing 200. The motor housing 200 includes a groove 202 on its external surface for mounting a stabilizer device included in the mud motor drilling assembly 116. The groove 202 may serve to locate or mount the stabilizer device on the motor housing 200. Although one groove 202 is shown, the motor housing 200 may include any number of grooves 202 for mounting the stabilizer device to the motor housing 200. The stabilizer device includes a stabilizer body 204, a threaded portion 206, and split-ring shells 208. The split-ring shells 208 include a ridge 210 on an internal surface corresponding to the groove 202 on the motor housing. The stabilizer device also includes a clamp 212 for coupling the stabilizer device to the motor housing 200.

The stabilizer body 204 includes an outer body 214 and an inner body 216. During operation of the drilling system 100, the outer body 214 may interfere with the walls of the wellbore 106 to stabilize the drilling system 100. In some aspects, the outer body 214 may be made of a wear-resistant material or hard-faced and may include blades or other protrusions. The inner body 216 is positioned against the external surface of the motor housing 200. The split-ring shells 208 may be positioned on the motor housing 200 between the groove 202 and the threaded portion 206. The split-ring shells 208 may be located on the motor housing 200 by positioning the ridge 210 in the groove 202 on the motor housing. Although one ridge 210 is shown on each of the split-ring shells 208, any number of ridges may be included on the split-ring shells 208. For example, the groove 202 in the motor housing 200 may be sized to receive two or more ridges 210. In another example, the number of ridges 210 may correspond to the number of grooves on the motor housing 200 and each groove 200 may be sized to receive a ridge 210. In some alternative aspects, the split-ring shells 208 may include a groove in place of the ridge 210 corresponding to a ridge on the motor housing 200 in place of the groove 202 to mount the split-ring shells 208 to the motor housing 200. The groove on the split-ring-shells 208 may be sized to receive the ridge on the motor housing 200.

The threaded portion 206 of the stabilizer device is integral to the stabilizer body 204 and is positioned between the groove 202 and the clamp 212, external to the split-ring shells 208. The threaded portion 206 includes an external surface 218 and an internal surface 220. The external surface 218 of the threaded portion 206 may include threads for coupling the clamp 212 to the stabilizer device. The internal surface 220 of the threaded portion 206 is positioned against the split-ring shells 208. In some aspects, the internal surface 220 may include a taper corresponding to a taper on an external edge of the split-ring shells 208. The internal surface 220 includes an internal surface edge 222. The internal surface edge 222 may support the stabilizer device in the axial direction when the stabilizer device is mounted on the motor housing 200. For example, the internal surface edge 222 may interfere with the split-ring shells 208 when drag forces moving axially uphole and downhole are placed on the stabilizer device.

The clamp 212 may couple the stabilizer device to the motor housing 200. The clamp 212 may be a cap, ring, bolt, or any component made of a resilient material (e.g., steel) for coupling the stabilizer device to the motor housing 200. The clamp 212 includes an inner surface 224. The inner surface 224 may have an inner diameter sized to be slid onto or otherwise positioned on the motor housing 200. The inner surface 224 has an inner channel 226 for receiving the split-ring shells 208 and the threaded portion 206. The inner surface 224 may also include threads in the inner channel 226 corresponding to the threads on the external surface 218 of the threaded portion 206. The clamp 212 may be threadably coupled to the stabilizer device by mating the threads on the threaded portion 206 with the threads on the clamp 212. The threaded coupling of the clamp 212 to the stabilizer device couples the stabilizer device to the motor housing 200. The inner channel 226 of the clamp 212 includes a channel edge 228. The channel edge 228, similar to the internal surface edge 222 of the threaded portion 206 supports the stabilizer device in the axial direction by interfering with the split-ring shells 208 when drag forces moving in the axial direction (uphole and downhole) are placed on the stabilizer device.

The stabilizer device may be symmetrical about its axis such that the radial distance from the axis of the motor housing 200 to the outer diameter of the stabilizer body 204 is constant as shown in FIG. 2. In some aspects, the stabilizer device may be offset such that blades or other protrusions on the stabilizer body 204 may include varying radii from the axis of the motor housing 200 to the outer diameter of each blade or protrusion. For example, the blades or protrusions on one side of the motor housing 200 include different radii from the axis of the motor housing 200 to the outer diameter of the blades or protrusions than blades or protrusions on an opposing side of the motor housing 200. In another example, there may be a blade on only one side of the stabilizer body 204 to form an offset pad arrangement. The arrangement may require orientation about the axis of the motor housing 200 in addition to an axial restraint.

Figure 3:
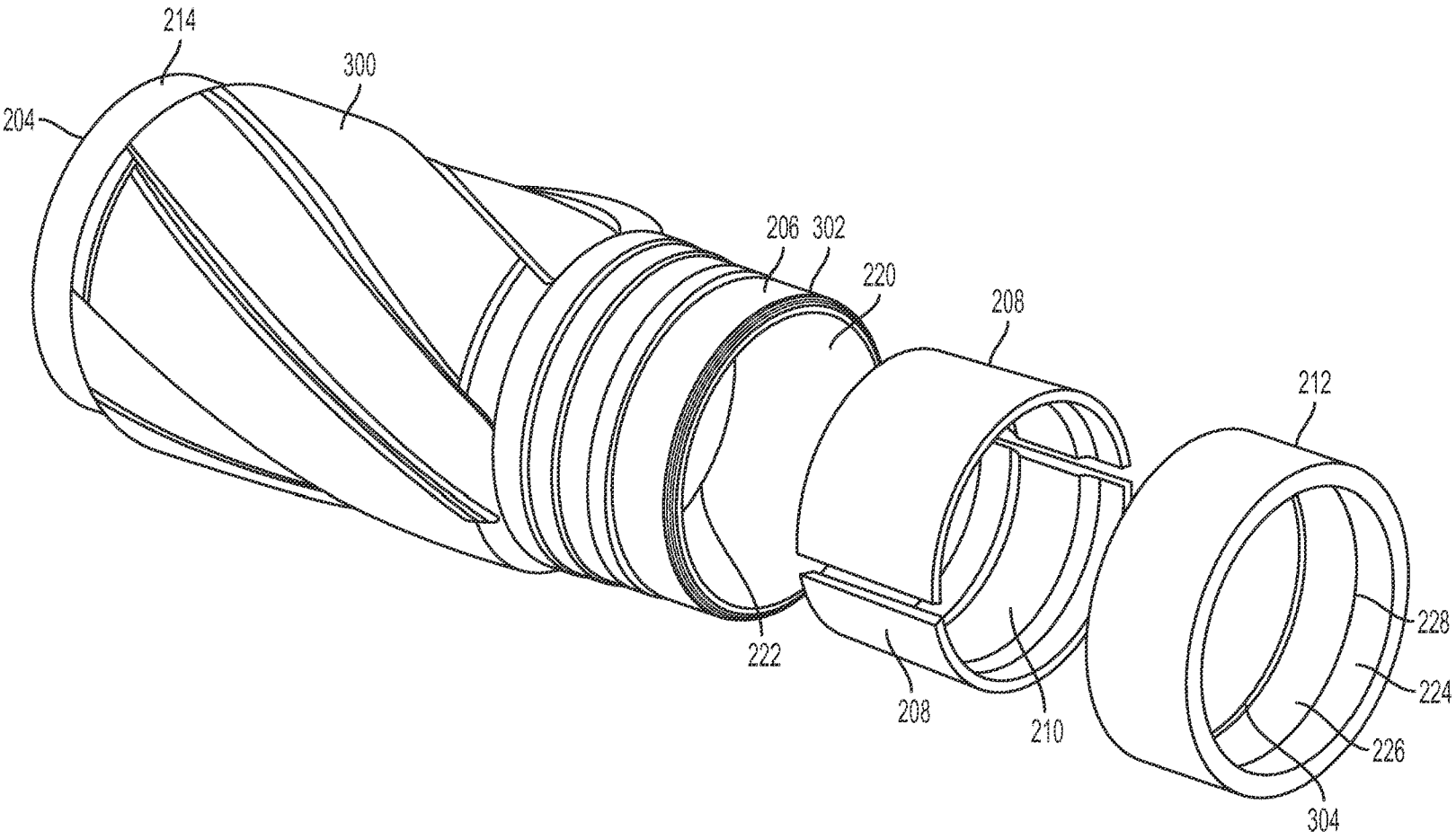
FIG. 3 is a perspective view of a disassembled stabilizer device of the mud motor drilling assembly of FIG. 2 according to one aspect of the present disclosure.

FIG. 3 shows a disassembled, perspective view of the stabilizer device. The outer body 214 of the stabilizer device includes blades 300 for interfering with the walls of the wellbore 106 during operation of the drilling system 100.

Although, the blades 300 are shown to be spiraled around the outer body 214 of the stabilizer device, the blades 300 or other protrusions have various shapes (e.g., straight) according to the design specifications of the stabilizer device. The external surface 218 of the threaded portion 206 of the stabilizer device includes threads 302. The threads 302 correspond to threads 304 in the inner channel 226 on the inner surface 224 of the clamp 212. For example, threads 302 may be female threads and threads 304 may be male threads. The threads 302 on the threaded portion 206 are positioned near an end of the threaded portion 206. The threads 304 on the clamp 212 are positioned near the clamp 212. The position of the threads 302, 304 on the threaded portion 206 and clamp 212, respectively, may vary according to the design specifications of the stabilizer device. Similarly, threads 302, 304 may include multiple sets of threads (e.g., threads 302 including a set of threads at one end of the threaded portion 206 and a set of threads at an opposite end of the threaded portion 206). In some aspects, the placement of the threads 302, 304 may be dependent on the size or position of the split-ring shells 208 relative to the size of the threaded portion 206 or clamp 212.

The split-ring shells 208 have an inner diameter sized for mounting to the motor housing 200. In some aspects, diameter of the split-ring shells 208 may allow the ends of the split-ring shells 208 to connect to form a continuous ring when mounted on the motor housing 200. In other aspects, the diameter of the split-ring shells may allow gaps between the ends of the split-ring shells 208 to form an open ring when mounted on the motor housing 200. Although two split-ring shells 208 are show, the split-ring shells may be any number of shells, including one. The shells may be made out of any resilient material (e.g., steel, tungsten carbide, etc.).

To install the stabilizer device onto the motor housing 200, the split-ring shells 208 may be mounted onto the motor housing 200. The ridge 210 on the inside of the split-ring shells 208 may be positioned in the groove 202 on the motor housing 200. The stabilizer device may be positioned proximate to the groove 202 on the motor housing 200 so that the internal surface 220 of the threaded portion 206 is positioned against the split-ring shells 208 mounted in the groove 202. The threads 304 on the clamp 212 may be mated with the threads 302 on the threaded portion 206 to couple the clamp 212 and the threaded portion 306. The threads 302, 304 may be positioned for the split-ring shells 208 and the threaded portion 206 to be received in the inner channel 226 of the clamp 212 as the clamp 212 is threadably coupled to the threaded portion 206. The coupling of the clamp 212 to the threaded portion 206 couples the stabilizer device to the motor housing 200. The stabilizer device is supported in the radial direction by the clamp 212. The stabilizer device is supported in the axial direction by the channel edge 228 on one axial end of the split-ring shells 208 and the internal surface edge 222 on the opposing axial end of the split-ring shells 208.

Figure 4:
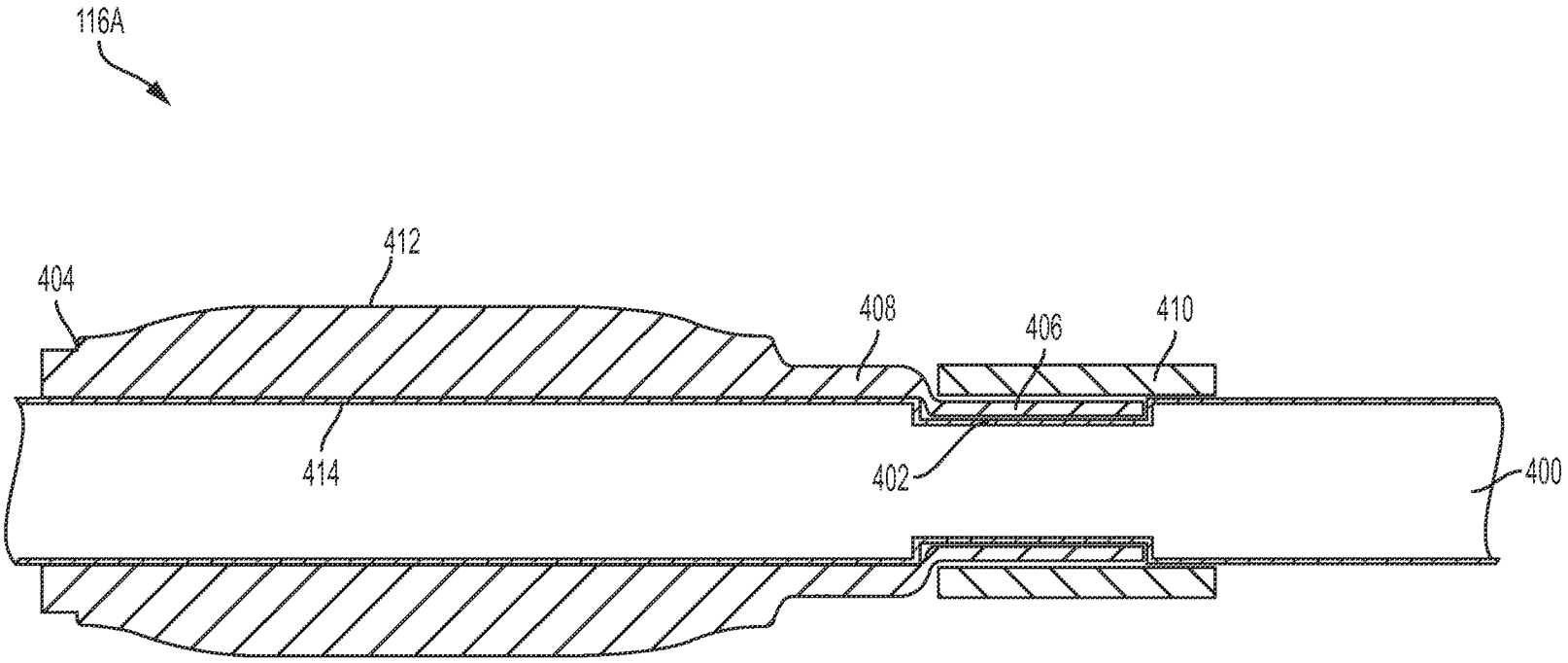
FIG. 4 is a cross-sectional view of a mud motor drilling assembly with stabilizer device according to another aspect of the present disclosure.

FIG. 4 shows a cross-sectional view of another example of a mud motor drilling assembly 116A that may be positioned in the downhole motor assembly 114 of the drilling system 100 in place of mud motor drilling assembly 116 of FIG. 1. The mud motor drilling assembly 116A may include a motor housing 400 having a groove 402. The mud motor drilling assembly 116A also includes a stabilizer device having a stabilizer body 404, a threaded portion 406, a flexure portion 408, and a clamp 410. The stabilizer body 404 includes an outer body 412 and an inner body 414. During operation of the drilling system 100, the outer body 412 may interfere with the walls of the wellbore 106 to stabilize the drilling system 100. In some aspects, the outer body 412 may be made of a wear-resistant material or hard-faced and may include blades or other protrusions. The inner body 414 is positioned against the external surface of the motor housing 400. The threaded portion 406 of the stabilizer device may be sized to be received in the groove 402 of the motor housing 400. The threaded portion 406, when positioned in the groove 402 may support the stabilizer device in the axial direction by interfering with the edges of the groove 402 when drag forces are applied to the stabilizer device in the axial direction. The clamp 410 may support the clamp in the radial direction. The clamp 410 may be torqued against a shoulder of the threaded portion 406 near the flexure portion 408 to ensure that the clamp 410 does not decouple from the threaded portion 406 during operation of the drilling system 100.

Figure 5:
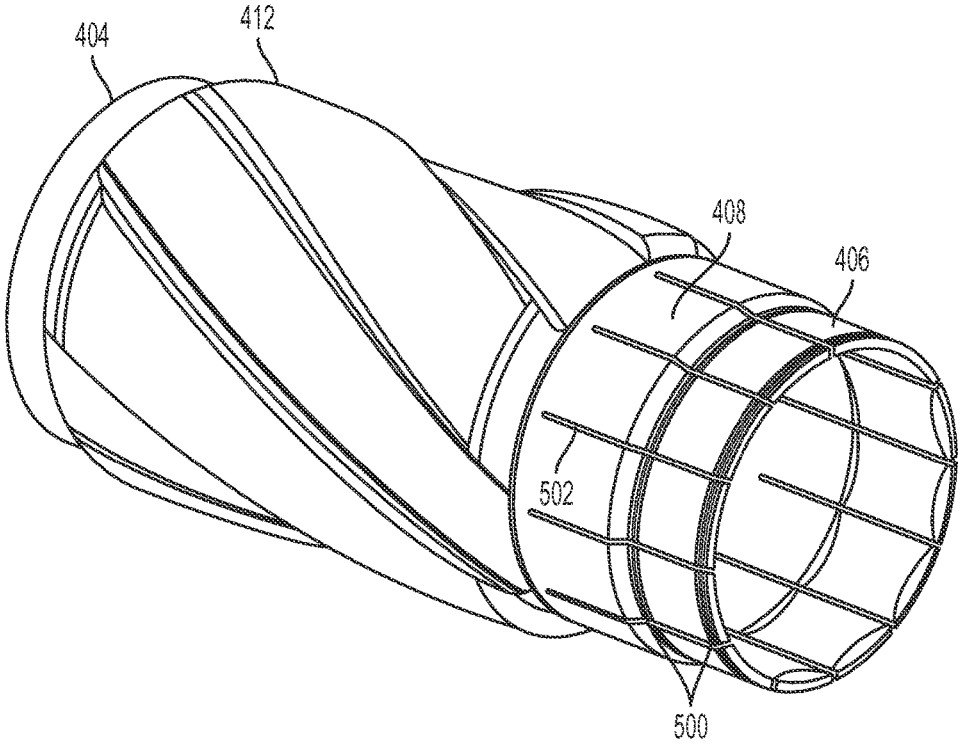
FIG. 5 is a perspective view of the stabilizer device of the mud motor drilling assembly of FIG. 4 according to one aspect of the present disclosure.

FIG. 5 shows a perspective view of the stabilizer device of FIG. 4. The threaded portion 406 is integral to the stabilizer body 404 and the flexure portion 408. The threaded portion 406 may include threads 500 on an external surface of the threaded portion 406 corresponding to threads on an inner surface of the clamp 410 for coupling the clamp 212 to the stabilizer device and coupling the stabilizer device to the motor housing 400. The threads 500 include two sets of threads, positioned at opposing ends of the external surface of the threaded portion 406. Any number or set of threads 500 may be included on the threaded portion 406. The threads 500 may also be positioned anywhere on the threaded portion 406 to mate with the threads on the clamp 410.

The flexure portion 408 of the stabilizer device is integral to the stabilizer body 404 and connects the threaded portion 406 to the stabilizer body 404. The flexure portion 408 may have bending properties (e.g., a hinge, crease, score, etc.) to increase the diameter of the threaded portion 406 as the stabilizer device is installed on the motor housing 400. The bending properties of the flexure portion 408 may position the threaded portion 406 in the groove 402 on the motor housing 400 when the flexure portion 408 is proximate to the groove 402 and the threaded portion 406 is positioned external to the groove 402. The flexure portion 408 may include castellations 502, or slits, that extend to the threaded portion 406. The castellations 502 extend partially through the flexure portion 408. The castellations 502 extend fully through the threaded portion 406 to create latch blocks of the threaded portion 406 sized to be received by the groove 402. The castellations 502 may allow for the increase in diameter of the threaded portion 406 by the flexure portion 408. The castellations 502 may be of any length or quantity without departing from the scope of the present disclosure.

To install the stabilizer device onto the motor housing 400, the stabilizer device may be slid or otherwise positioned on the motor housing 400. The positioning of stabilizer device on the motor housing 400 may force the flexure portion 408 to a larger diameter, the flexure portion 408 in turn forcing the threaded portion 406 to a larger diameter, to pass over the diameter of the motor housing 400. The stabilizer device may be positioned proximate to the groove 402 so that the threaded portion 406 is positioned external to the groove 402. The bending properties of the flexure portion 408 may allow the flexure portion 408 to position the threaded portion 406 in the groove 402 and return the flexure portion 408 and threaded portion 406 to its original diameter. The clamp 410 may be threadably coupled to the stabilizer device by mating the threads 500 on the threaded portion 406 with corresponding threads on the clamp 410. The coupling of the clamp 410 to the threaded portion 406 couples the stabilizer device to the motor housing 400.

In some aspects, the mud motor drilling assemblies are provided according to one or more of the following examples:

Example #1

A mud motor drilling assembly may include a motor housing having a groove or ridge for mounting a stabilizer device to the motor housing. The mud motor drilling assembly may also include the stabilizer device. The stabilizer device may be external to the motor housing and include a threaded portion having external threads on an external surface of the threaded portion corresponding to internal threads on a clamp for coupling the stabilizer device to the motor housing. The threaded portion may be positioned between the clamp and the groove or the ridge.

Example #2

The mud motor drilling assembly of Example #1 may feature the stabilizer device further including a stabilizer body. The stabilizer body may have an outer body and an inner body. The outer body may have stabilizer blades for interfering with a wellbore wall. The inner body may be positioned against the motor housing.

Example #3

The mud motor drilling assembly of Example #2 may feature the threaded portion of the stabilizer device as integral to the stabilizer body.

Example #4

The mud motor drilling assembly of Examples #1-3 may feature the stabilizer device further including a split-ring shell mounted on the motor housing. The split-ring shell may be positioned between the threaded portion of the stabilizer device and the groove or the ridge. The split-ring shell may include an internal ridge positioned in the groove or an internal groove positioned on the ridge.

Example #5

The mud motor drilling assembly of Examples #1-4 may feature the stabilizer device further including the clamp having an inner surface including the internal threads.

Example #6

The mud motor drilling assembly of Example #5 may feature the inner surface of the clamp including an inner channel. The threaded portion of the stabilizer device may be positioned in the inner channel.

Example #7

The mud motor drilling assembly of Example #6 may feature the inner channel including a channel edge for interfering with a split-ring shell mounted on the motor housing to support the stabilizer device in an axial direction. The threaded portion of the stabilizer device may include an internal surface positioned against the split-ring shell. The internal surface may have an internal surface edge for interfering with the split-ring shell to support the stabilizer device in the axial direction.

Example #8

The mud motor drilling assembly of Examples #1-7 may feature the motor housing including the groove. The threaded portion of the stabilizer device may be further positioned in the groove to allow the clamp to threadably couple the clamp to the stabilizer device.

Example #9

The mud motor drilling assembly of Examples #1-8 may feature the motor housing including the groove. The stabilizer device may further include a flexure portion for locating the threaded portion of the stabilizer device in the groove. The flexure portion may include castellations.

Example #10

The mud motor drilling assembly of Example #9 may feature the threaded portion of the stabilizer device being integral to the flexure portion and including the castellations.

Example #11

A stabilizer device may include a stabilizer body for interfering with a wellbore wall. The stabilizer device may also include a threaded portion having external threads on an external surface of the threaded portion for coupling a clamp to couple the stabilizer device to a motor housing. The threaded portion may be positionable between the clamp and a groove or ridge in the motor housing. The stabilizer device may also include the clamp having internal threads on an inner channel of the clamp corresponding to the external threads on the threaded portion for coupling the clamp to the stabilizer body.

Example #12

The stabilizer device of Example #11 may feature a split-ring shell. The split-ring shell may have an internal ridge sized to be receivable by the groove or an internal groove sized to receive the ridge for mounting the split-ring shell to the motor housing.

Example #13

The stabilizer device of Example #12 may feature the inner channel being sized to receive the split-ring shell and the threaded portion of the stabilizer device. The inner channel may have a channel edge for interfering with the split-ring shell mounted on the motor housing to support the stabilizer device in an axial direction.

Example #14

The stabilizer device of Examples #12-13 may feature the threaded portion including an internal surface positionable against the split-ring shell. The internal surface may have an internal surface edge for interfering with the split-ring shell to support the stabilizer device in an axial direction.

Example #15

The stabilizer device of Example #11 may feature the motor housing including the groove. The threaded portion may be further positionable in the groove. The stabilizer device may further include a flexure portion for positioning the threaded portion in the groove to mount the stabilizer device to the motor housing.

Example #16

The stabilizer device of Example #15 may feature the threaded portion being integral to the stabilizer body and the flexure portion. The flexure portion and the threaded portion may have castellations.

Example #17

A method for installing a stabilizer device on a motor housing may include providing the motor housing, a clamp, and the stabilizer device. The method may also include positioning the stabilizer device on the motor housing proximate to a groove or ridge on the motor housing. The method may also include threadably coupling the clamp to the stabilizer device by mating external threads on a threaded portion of the stabilizer device with internal threads on an inner channel of the clamp to couple the stabilizer device to the motor housing.

Example #18

The method of Example #17 may feature positioning the stabilizer device on the motor housing proximate to the groove on the motor housing including positioning the threaded portion of the stabilizer device to allow a flexure portion of the stabilizer device to position the threaded portion in the groove.

Example #19

The method of Examples #17-18 may feature positioning the stabilizer device on the motor housing proximate to the groove or the ridge including positioning an internal surface of the threaded portion of the stabilizer device against a split-ring shell mounted in the groove or on the ridge of the motor housing by an internal ridge on the split-ring shell or an internal groove in the split-ring shell. Positioning the stabilizer device on the motor housing proximate to the groove or the ridge may further include positioning an internal surface edge of the threaded portion proximate to an edge of the split-ring shell to support the stabilizer device in an axial direction.

Example #20

The method of Examples #17-19 may feature threadably coupling the clamp to the stabilizer device including positioning the inner channel of the clamp to receive the threaded portion of the stabilizer device. Threadably coupling the clamp to the stabilizer device may further include positioning a channel edge of the inner channel proximate to an edge of a split-ring shell mounted in the groove or on the ridge of the motor housing to support the stabilizer device in an axial direction.

The foregoing description of the examples, including illustrated examples, has been presented only for the purpose of illustration and description and is not intended to be exhaustive or to limit the subject matter to the precise forms disclosed. Numerous modifications, adaptations, uses, and installations thereof can be apparent to those skilled in the art without departing from the scope of this disclosure. The illustrative examples described above are given to introduce the reader to the general subject matter discussed here and are not intended to limit the scope of the disclosed concepts.

What is claimed is:

1. A mud motor drilling assembly, comprising:

a motor housing having a groove or ridge for mounting a stabilizer device to the motor housing;

the stabilizer device external to the motor housing, the stabilizer device including a threaded portion having external threads on an external surface of the threaded portion corresponding to internal threads on a clamp for coupling the stabilizer device to the motor housing, the threaded portion being positioned between the clamp and the groove or the ridge; and a split-ring shell mounted on the motor housing, the split-ring shell being positioned between the threaded portion of the stabilizer device and the grove or the ridge, the split-ring shell including an internal ridge positioned in the groove or an internal groove positioned on the ridge.

2. The mud motor drilling assembly of claim 1, wherein the stabilizer device further includes a stabilizer body having an outer body and an inner body, the outer body having stabilizer blades for interfering with a wellbore wall, the inner body being positioned against the motor housing.

3. The mud motor drilling assembly of claim 2, wherein the threaded portion of the stabilizer device is integral to the stabilizer body.

4. The mud motor drilling assembly of claim 1, wherein the stabilizer device further includes the clamp having an inner surface including the internal threads.

5. The mud motor drilling assembly of claim 4, wherein the inner surface of the clamp includes an inner channel, the threaded portion of the stabilizer device being positioned in the inner channel.

6. The mud motor drilling assembly of claim 5, wherein the inner channel includes a channel edge for interfering with the split-ring shell mounted on the motor housing to support the stabilizer device in an axial direction;

wherein the threaded portion of the stabilizer device includes an internal surface positioned against the split-ring shell, the internal surface having an internal surface edge for interfering with the split-ring shell to support the stabilizer device in the axial direction.

7. A system, comprising:

a stabilizer including:

a stabilizer body for interfering with a wellbore wall;

a threaded portion having external threads on an external surface of the threaded portion for coupling to a clamp configured to couple the stabilizer to a motor housing, the threaded portion being positionable between the clamp and a groove or ridge in the motor housing;

the clamp, the clamp having internal threads on an inner channel of the clamp corresponding to the external threads on the threaded portion for coupling the clamp to the stabilizer body; and a split-ring shell having an internal ridge sized to be by the groove or an internal groove sized to receive the ridge for mounting the slip-ring shell to the motor housing.

8. The system of claim 7, wherein the inner channel is sized to receive the split-ring shell and the threaded portion of the stabilizer, the inner channel having a channel edge for interfering with the split-ring shell mounted on the motor housing to support the stabilizer in an axial direction.

9. The system of claim 7, wherein the threaded portion includes an internal surface positionable against the split-ring shell, the internal surface having an internal surface edge for interfering with the split-ring shell to support the stabilizer in an axial direction.

10. The system of claim 7, wherein the threaded portion is integral to the stabilizer body.

11. A method for installing a stabilizer device on a motor housing, the method comprising:

providing the motor housing, a clamp, a split-ring shell, and the stabilizer device;

mounting the split-ring shell in a groove or on a ridge of the motor housing;

coupling the stabilizer device to the split-ring shell on the motor housing; and threadably coupling the clamp to the stabilizer device by mating external threads on a threaded portion of the stabilizer device with internal threads on an inner channel of the clamp to couple the stabilizer device to the motor housing.

12. The method of claim 11, wherein coupling the stabilizer device to the split-ring shell includes:

positioning an internal surface of the threaded portion of the stabilizer device against the split-ring shell; and positioning an internal surface edge of the threaded portion of the stabilizer device proximate to an edge of the split-ring shell to support the stabilizer device in an axial direction.

13. The method of claim 11, wherein threadably coupling the clamp to the stabilizer device includes:

positioning the inner channel of the clamp to receive the threaded portion of the stabilizer device; and positioning a channel edge of the inner channel proximate to an edge of the split-ring shell mounted in the groove or on the ridge of the motor housing to support stabilizer device in an axial direction.

* * * * *